United States Patent [19]

Novak et al.

[11] 4,377,931

[45] Mar. 29, 1983

[54] FLYER FOR ROVING FRAME

[75] Inventors: Peter Novak; Bruno Tanner, both of Winterthur, Switzerland

[73] Assignee: Rieter Machine Works Limited, Winterthur, Switzerland

[21] Appl. No.: 243,921

[22] PCT Filed: Jun. 30, 1980

[86] PCT No.: PCT/EP80/00039

§ 371 Date: Mar. 9, 1981

§ 102(e) Date: Mar. 2, 1981

[87] PCT Pub. No.: WO81/00119

PCT Pub. Date: Jan. 22, 1981

[30] Foreign Application Priority Data

Jul. 9, 1979 [CH] Switzerland ..... 6377/79

[51] Int. Cl.[3] ..... D01H 7/32

[52] U.S. Cl. ..... 57/117

[58] Field of Search ..... 57/67–71, 57/115, 116, 117

[56] References Cited

U.S. PATENT DOCUMENTS

| | | | |
|---|---|---|---|
| 355,794 | 1/1887 | Smith | 57/117 |
| 1,103,654 | 7/1914 | Burlin | 57/117 |
| 3,157,020 | 11/1964 | Schwager | 57/117 |
| 3,216,185 | 11/1965 | Gallina | 57/117 |
| 3,782,099 | 1/1974 | Schwager | 57/117 |
| 4,060,969 | 12/1977 | Costales et al. | 57/117 X |

*Primary Examiner*—John Petrakes

*Attorney, Agent, or Firm*—Werner W. Kleeman

[57] ABSTRACT

The present invention concerns a flyer for roving frames. According to the invention the flyer arms (14,16) at their free ends are connected rigidly with a ring (17). Furthermore, an enclosed guide duct with a guide tube (22) is provided for the roving, which guide tube (22) is supported to be pivotable about its longitudinal axis and supports a presser finger (25). Thus, a flyer of relatively low weight results, but of high solidity, permitting high rotational speeds. The guide duct for the roving can be of enclosed shape over a maximum of its length.

17 Claims, 2 Drawing Figures

FLYER FOR ROVING FRAME

BACKGROUND OF THE INVENTION

The present invention concerns a flyer with two flyer arms and with an enclosed guide duct comprising a straight guide tube for a roving, which at a spinning position of a spinning preparatory machine is guided from a drafting arrangement through the guide duct over a presser finger, which at its free end is provided with a yarn guide.

From British Pat. No. 380,745 a flyer is known, in which two flyer arms are formed by steel tubes, and which is provided with two additional auxiliary arms. The lower ends of these four arms are stiffened by a hoirzontal ring. As seen from the point of view of solidity or strength, this flyer can achieve high rotational speeds. In this flyer, however, no presser finger is provided, and thus the deposition of the roving onto the bobbin tube is uncontrolled and thus is effected with insufficient exactness. Furthermore, the duct for the roving is partially open, which detrimentally influences the roving quality.

In a flyer design known from German Pat. No. 1,685,910 the flyer is designed as an open flyer. The flyer arm guiding the roving, or both flyer arms, comprise an inner steel tube, which is surrounded by aluminium, stiffening of the flyer being aimed at mainly when using this arrangement. For the presser finger used for guiding the roving a special presser rod is provided. This presser rod adds an additional weight, which (for symmetry reasons) is to be compensated for at the other arm and thus is doubled. The lack of the horizontal ring in this second mentioned known arrangement implies the disadvantage that the mutual distance of the lower ends of the flyer arms increases at high rotational speeds of the spinning flyer. In consequence of this the quality of the roving suffers and it is no longer properly and evenly wound onto the bobbin tube. Enlargement of the distance between the flyer arms furthermore creates the danger of flyer breakages and thus the danger of injuries to the personnel.

SUMMARY OF THE INVENTION

These disadvantages are to be avoided according to the present invention. The invention is characterized in that the bottom ends of the flyer arms are connected with a ring, that the straight guide tube is supported in an upper and in a lower pivoting bearing and is supported to be rotatable about its longitudinal axis, and that the presser finger is rigidly connected with the guide tube.

Obviously, noticeably less weight is added to the flyer if the horizontal ring is provided, than must be added for stiffening the flyer arms if these are not provided with a horizontal ring. Based on the fact that the guide tube does not exert any support function, a further advantage is seen in that the guide tube can be made from any suitable desired material, e.g. also partially from a ceramic material.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
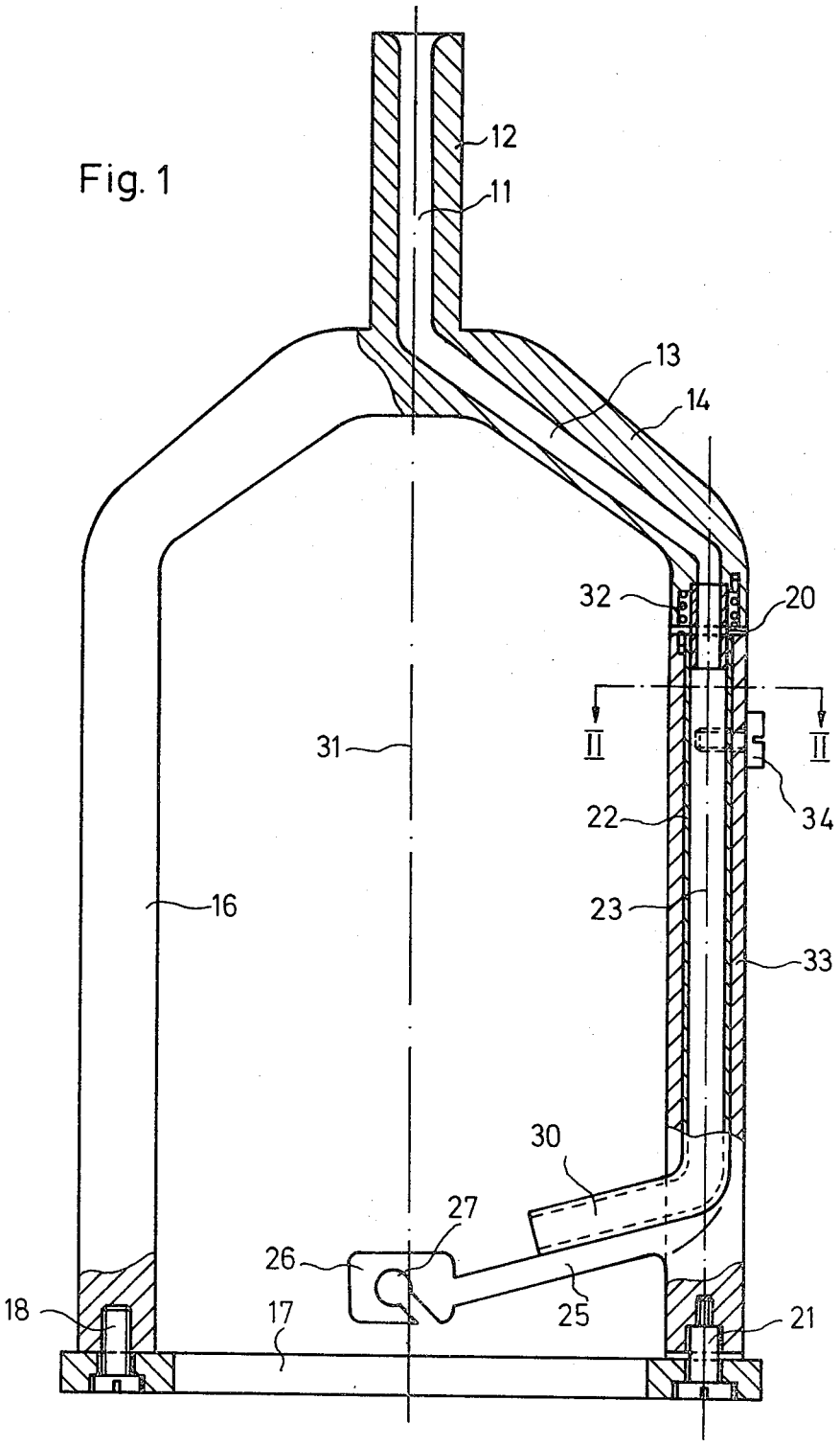
FIG. 1 is a section of a flyer seen from its side.

In both Figures, identical structure has been designated with the same reference characters.

Figure 2:
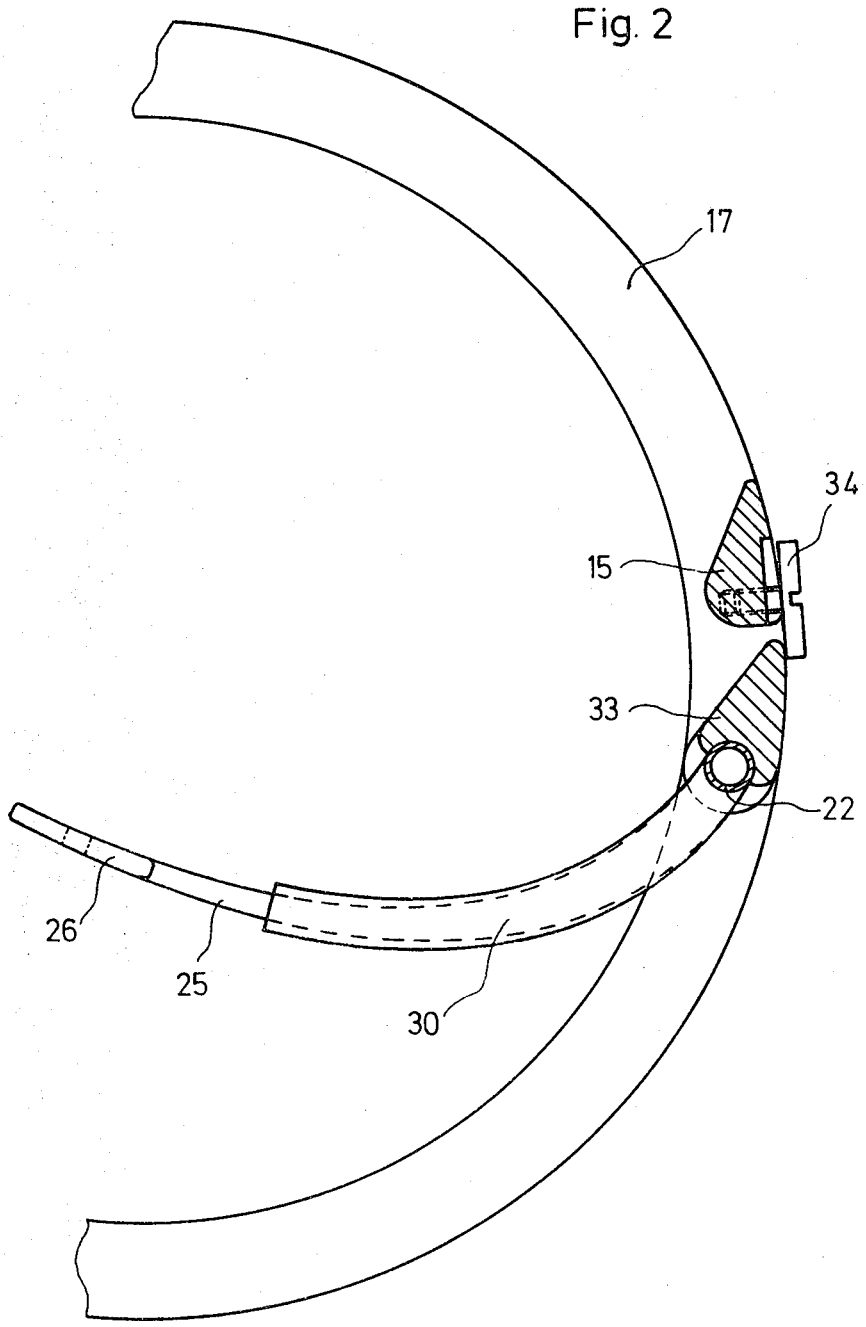
FIG. 2 is a horizontal section along line II—II of FIG. 1 in an enlarged view.

The flyer shown in FIG. 1 comprises a hollow cylinder 12 provided with a bore 11, the hollow cylinder 12 being rotatably supported in a bearing (not shown). From this cylinder 12 there extends an arm portion 14 comprising a tubular supply duct 13. This arm portion 14 together with a vertical arm portion 15, which is not visible in FIG. 1 because it is located behind a guide tube 22 depicted in FIG. 1 but is shown in FIG. 2, forms, as a rigid unit, one arm 14,15 of the flyer. From the hollow cylinder 12 there furthermore extends a second flyer arm 16 consisting of an inclined portion and a vertical portion.

The bottom ends of the arm 14,15 and of the arm 16 are connected with a horizontal ring 17. In the embodiment shown, the arm 16 is rigidly connected with the ring 17 using a threaded bolt or screw 18, but any type of mounting, such as e.g. also the casting in one piece is considered within the scope of the present invention.

The aforementioned guide tube 22, which is located in front of the vertical arm portion 15 in the showing of FIG. 1, is supported in an upper pivoting bearing 20 and in a lower pivoting bearing 21. The upper pivoting bearing 20 is mounted onto the arm portion 14. The lower pivoting bearing 21, as shown in the embodiment illustrated, is built into the ring 17. The bearings 20,21 are arranged with respect to the guide tube 22 in such a manner that pivoting of the guide tube 22 is effected about its longitudinal axis 23. Advantageously, the supply duct 13 is provided with a short tubular extension, which for forming the upper bearing 20 extends into the guide tube 22. The lower bearing 21 also, instead of being built into the ring 17 as shown in FIG. 1, can be arranged, e.g. on a member extending towards the location of the bearing 21, which member is located at the lower end of the bottom arm portion 15.

A presser finger 25 is rigidly connected with the guide tube 22. It is equipped at its free end with a yarn guide 26 for the roving, which is provided with an eyelet 27. A bent tube 30 forms an extension of the guide tube 22. Its free end is directed towards the roving guide 26. The bore 11, the supply duct 13, the guide tube 22 and the bent tube 30 together form a guide duct for the roving being produced during operation of the flyer. The tube 30, in the design example illustrated, is mounted upon the presser finger 25.

For the spinning process spindle (not shown) is provided at each spinning position, the rotational axis of which coincides with the rotational axis 31 of the corresponding flyer. Using a pre-tensioning element formed by a helical spring 32 the guide tube 22 and together with it the presser finger 25, rigidly mounted thereon, are subject to a constantly acting pre-tension directed towards the axis 31, i.e. towards the spindle (not shown).

The guide tube 22 furthermore is connected with a counterweight 33, which also is pivotable together with the guide tube 22 about the lengthwise or longitudinal axis 23 thereof. While the flyer rotates, the counterweight 33 is subject to a centrifugal force directed towards the outside. Thus a torque momentum is generated, which is opposed to the one generated by the presser finger 25. In this manner the presser finger 25 is pressed onto the spindle by the counterweight 33 in the same sense of rotation as effected by the helical spring 32. The torque momentum torque generated by the counterweight 33 and the pre-tension generated by the spring 32 tend to rotate the guide tube, as shown in the view of FIG. 2, clockwise. A stop 34 limits the extent of such movement. It is formed in the embodiment shown as a screw mounted upon the vertical arm portion 15. By rotating the screw 34 the end or terminal position of the pivoting movement of the presser finger 25 thus can be set as desired.

During operation the roving is guided from a drafting arrangement (not shown), through the guide duct, which comprises, as already mentioned, the bore 11, the supply duct 13, the guide tube 22 and the bent tube 30. At the same time twist is imparted permanently to the roving supplied by the drafting arrangement by the rotation of the flyer, in such a manner that at the exit end or outlet of the tube 30 a roving emerges, which, using the presser finger 25, is wound up as a roving onto the spindle, arranged concentrically with the axis 31, as mentioned above but not shown. During the spinning process also the spindle is rotated constantly about its axis which coincides with the rotational axis 31. Additionally, the spindle moves up and down with respect to the flyer. During this process the presser finger 25 constantly is pre-tensioned or pressed against the spindle, or against a bobbin tube placed thereon, and places roving wraps onto it as layers. It is to be mentioned in this context, that in the patent claims the term "roving" is used for simplicity in expression, even if in reality a spinning process is considered, in which immediately after emerging from the drafting arrangement, i.e. before entering the bore 11, a roving provided with a determined twist is not yet present.

After emerging from the bent tube 30 the roving is wound about the presser finger 25, one or a plurality of wraps being formed, and subsequently is transferred via the eyelet 27 onto the bobbin tube placed onto the spindle, or onto the winding layers already present thereon. The inventive flyer shows the further advantage that the roving rotating about the axis 31 is located practically over the total part of its path in an enclosed duct, and that thus blowing-off of the fibres due to the extraordinarily high rotational speeds practically does not occur. Thus, also the formation of fibre fly waste in the spinning room is considerably reduced. For these reasons it proves advantageous to choose a relatively long length of the bent tube 30, as in this manner the roving portion exposed in the free room is shortened further again. Furthermore, the wraps about the presser finger become narrower if the distance between the free end of the tube 30 from the eyelet 27 is shorter in such a manner that, applying less wraps on the presser finger 25 the same braking force which is decisive for the density of the bobbin package is obtained on the roving than with more wraps spread over a greater length. It thus proves advantageous if the bent tube 30 extends to over half the length of the presser finger 25. Of course the type of fibre material processed has an influence in this respect.

Furthermore, the inventive flyer proves very advantageous if applied in a machine with automatic bobbin change system, in which the roving bobbin package is doffed by lifting it up and off, and the new, empty bobbin tube is donned from above. For freeing the upward path, the flyer in these machines is tilted to an inclined position in such manner that the plane defined by the arms 14,15 and 16 is brought into an inclined position (with respect to the bobbin axis). Owing to the fact that the presser finger 25, activated by the spring 32, contacts the layers on the bobbin package also while the flyer is at a standstill, severing of the roving between the eyelet 27 and the layers while the bobbin package is moved up and off is effected very reliably and at the desired point. Also owing to the permanently pre-tensioned or pressed-on presser finger 25 secured catching of the roving end, or the roving beard respectively, held by the eyelet by the freshly donned bobbin tube, is ensured.

Finally, a further, important characteristic is to be mentioned. It is not a rare occurrence, that during operation of a roving frame certain spinning positions are to be shut off, i.e. are to be operated without fibre material. In this case the individual spindles of such a machine cannot be stopped individually as desired, but they continue rotating idle. The adjustable stop 34 permits adaption (of the movement) of the presser finger 25 in such manner, that an operation mode is possible without complications, in which the individual spinning positions not provided with fibre material and thus the corresponding spindles rotate idle, i.e. without a bobbin tube. The distance of the yarn guide 26 from the outer spindle surface in this arrangement is set by the adjustable stop 34 in such manner that these two elements show a small clearance between them, and thus mutual contact and wear of said elements is avoided.

While there are shown and described present preferred embodiments of the invention, it is to be distinctly understood that the invention is not limited thereto, but may be otherwise variously embodied and practiced within the scope of the following claims. Accordingly,

We claim:

1. A flyer having a rotational axis and comprising:
two flyer arms;
means defining a substantially enclosed guide duct;
said guide duct including a substantially straight guide tube for guiding a roving and having a lengthwise axis;
a presser finger having a free end;
said roving being guided through said guide duct over said presser finger;
said presser finger being provided at said free end with a yarn guide;
said flyer arms having bottom ends;
a ring with which there are connected said bottom ends of said flyer arms;
an upper pivot bearing and a lower pivot bearing for supporting said straight guide tube so as to be rotatable about said lengthwise axis thereof; and
said presser finger being rigidly connected with said guide tube.

2. The flyer as defined in claim 1, further including:
a pre-tensioning element acting upon said guide tube and exerting a torque thereon which at all times biases the presser finger in the direction of said rotational axis of the flyer.

3. The flyer as defined in claim 2, further including:
adjustable stop means provided at one of said flyer arms;
said adjustable stop means defining an end position of said guide tube which is subjected to the action of said pre-tensioning element; and means for enabling adjustment of the position of said stop means.

4. The flyer as defined in claim 2, wherein:

the pre-tensioning element comprises elastic means incorporated between one of said flyer arms and said guide tube.

5. The flyer as defined in claim 1, wherein:

said two flyer arms are made from light metal.

6. The flyer as defined in claim 1, further including:

a tube portion extending from a lower end region of said guide tube and forming an extension thereof;

said presser finger having a yarn guide; and said tube portion having a free end directed towards said yarn guide of said presser finger.

7. The flyer as defined in claim 6, wherein:

said tube portion extends over more than one-half of the length of the presser finger.

8. The flyer as defined in claim 6, wherein:

said presser finger is connected with said tube portion.

9. The flyer as defined in claim 6, wherein:

at least said guide tube partially consists of a light metal.

10. The flyer as defined in claim 6, wherein:

at least said guide tube partially consists of a non-metallic material.

11. The flyer as defined in claim 10, wherein:

said non-metallic material is a ceramic material.

12. The flyer as defined in claim 6, wherein:

said tube portion at least partially consists of light metal.

13. The flyer as defined in claim 6, wherein:

said tube portion at least partially consists of a non-metallic material.

14. The flyer as defined in claim 13, wherein:

said non-metallic material is a ceramic material.

15. The flyer as defined in claim 1, wherein:

one of said flyer arms contains an upper arm member and serves to supply roving;

said guide duct comprising a supply duct located inside said upper arm member of said one flyer arm; and said supply duct having an exit end extending into an upper end of said guide tube.

16. The flyer as defined in claim 1, wherein:

said lower pivot bearing is mounted at said ring.

17. The flyer as defined in claim 1, further including:

a counterweight located with respect to the lengthwise axis of the guide tube at a side situated opposite the presser finger.

* * * * *